United States Patent [19]

Tikhonova et al.

[11] 3,947,268

[45] Mar. 30, 1976

[54] MAGNESIUM-BASE ALLOY

[76] Inventors: Vera Viktorovna Tikhonova, Trubnikovsky pereulok, 19, kv. 11; Alexandr Ivanovich Markov, ulitsa Veernaya, 34, kv. 99; Marina Andreevna Gerasimova, Alleya Zhemchugovoi, 3 korpus 3, kv. 71; Galina Ivanovna Zhukova, ulitsa Krasny Kazanets, 19, korpus 1, kv. 277; Morits Borisovich Altman, Mironovskaya ulitsa, 9, kv. 100; Margarita Alexandrovna Timonova, 13 Parkovaya ulitsa, 31, korpus 1, kv. 32; Tatyana Ivanovna Ershova, ulitsa Shvernika 18, korpus 2, kv. 74, all of Moscow; Boris Trofimovich Krysin, Parkovaya ulitsa, 7, kv. 120, Balashikha Moskovskoi oblasti; Georgy Gerasimovich Kitari-Oglu, Planetnaya ulitsa, 18, kv. 23, Moscow; Galina Ivanovna Morozova, B. Cherkizovskaya ulitsa 10, korpus 10, kv. 9, Moscow; Nikolai Fedorovich Lashko, ulitsa Kosinskaya, 18, korpus 3, kv. 272, Moscow, all of U.S.S.R.

[22] Filed: Aug. 24, 1973

[21] Appl. No.: 391,274

[52] U.S. Cl. ..... 75/168 B; 75/168 C; 75/168 M; 75/168 K; 75/168 L

[51] Int. Cl.[2] ..... C22C 23/02; C22C 23/04

[58] Field of Search ..... 75/168 R, 168 B, 168 C, 75/168 D, 168 K, 168 M, 168 L

[56] References Cited

UNITED STATES PATENTS

| | | | |
|---|---|---|---|
| 2,264,309 | 12/1941 | Hanawalt et al. | 75/168 C |
| 2,340,,795 | 1/1944 | Christen | 75/168 C |

FOREIGN PATENTS OR APPLICATIONS

| | | | |
|---|---|---|---|
| 511,291 | 8/1939 | United Kingdom | 75/168 C |

*Primary Examiner*—C. Lovell
*Attorney, Agent, or Firm*—Holman & Stern

[57] ABSTRACT

An alloy containing: aluminum, zinc, manganese, titanium, zirconium and doping agents, with the weight percentage of the components being as follows: aluminum 2–12; zinc, 0.01–2.5; manganese, 0.01–2.5; titanium, 0.0001–0.5; zirconium, 0.002–2.0; beryllium, up to 0.1; iron, up to 0.01; nickel, up to 0.001; silicon up to 0.08; copper, up to 0.04; and magnesium, the balance.

3 Claims, No Drawings

MAGNESIUM-BASE ALLOY

BACKGROUND OF THE INVENTION

The present invention relates to magnesium-base alloys and is most advantageous in industry for the production of articles featuring high corrosion resistance when operation in air, marine and tropical atmospheric conditions and for short-term operation in sea water.

Magnesium-base corrosion-resistant alloys of a Al-Zn-Mn system and an alloy comprising additionally titanium (see, for example, US Pat. No. 2,340,795) are known in the art, and whose compositions are given in Table 1.

Table 1

| Mg | Al | Zn | Mn | Ti | Chemical composition,% Doping agents,% not more than Ni | Cu | Fe | Si | Be | Zr |
|---|---|---|---|---|---|---|---|---|---|---|
| Base | 7.5–9 | 0.2–0.8 | 0.15–0.5 | — | 0.001 | 0.040 | 0.007 | 0.08 | 0.002 | 0.002 |
| Base | 7.5–9 | 0.3–1.0 | 0.15–0.7 | — | 0.001 | 0.005 | 0.003 | 0.01 | — | — |
| Base | 4–6 | 1–2 | 0.1–1 | 0.05–1 | — | — | — | — | — | — |

A disadvantage of the above-specified alloys lies in their comparatively low corrosion resistance.

SUMMARY OF THE INVENTION

The main object of the invention is the provision of a magnesium-base alloy featuring high corrosion resistance.

Said object is achieved by the provision of a magnesium-base alloy containing aluminum, zinc, manganese, titanium and doping agents, with the alloy comprising additionally, according to the invention, zirconium and with the weight percentage of the components being as follows: aluminum, 2–12; zinc, 0.01–2.5; manganese 0.01–2.5; titanium 0.0001–0.5; zirconium, 0.002–2; with the following content for the doping agents: beryllium up to 0.1; iron, up to 0.01; nickel, up to 0.001; silicon, up to 0.08; copper, up to 0.04 and magnesium, the balance.

The above chemical composition of the proposed alloy ensures the enhancement of its corrosion resistance as compared to the known alloys.

DETAILED DESCRIPTION OF PREFERRED EMBODIMENTS

Illustrative examples of the embodiment of the present invention are given hereinbelow.

Example 1.

The composition of an alloy is as follows, in weight per cent: aluminum, 7.7; zinc, 2.0; manganese, 0.5; titanium, 0.005; zirconium, 0.3; iron, 0.007; nickel, 0.0007; silicon, 0.03; copper, 0.02; and magnesium, the balance.

The corrosion velocity of the as-cast and heat-treated alloy completely immersed in a 3% solution of NaCl for 48 hrs amounts to 0.0180 mg/cm²hr. Its corrosion resistance in a damp and tropical atmosphere and upon being rinsed periodically with sea water, is similar to aluminum cast alloys of the Al-Si-Mg system.

The mechanical properties of the alloy in the as-heat treated state at room temperature are as follows: tensile strength $|\sigma\rho|$=23–26 kg/mm², and relative elongation $|\delta|$= 3–10%.

Example 2.

The composition of an alloy in weight percent is as follows: aluminum, 2; zinc, 2.5; manganese, 2.5; titanium, 0.5; zirconium, 0.002; iron, 0.01; nickel, 0.001; silicon, 0.08; copper, 0.04; and magnesium, the balance.

In an as-cast state the corrosion velocity of the alloy when immersed completely in a 3 % solution of NaCl for 48 hrs amounts to 0.0100 mg/cm²hr.

The mechanical properties of the alloy in the as heat-treated condition at room temperature amounted to: tensile strength $|\sigma\rho|$=18–20 kgf/mm², and relative elongation $|\delta|$= 8–10%.

Example 3.

The composition of an alloy is as follows, weight per cent: aluminum, 12; zinc, 0.01; manganese, 0.01; titanium, 0.0001; zirconium, 2; beryllium, 0.1; iron, 0.003; nickel, 0.001; silicon, 0.01; copper, 0.02; and magnesium, the balance.

The corrosion velocity of the alloy in the as-heat treated condition when immersed completely in a 3 % solution of NaCl for 48 hrs was equal to 0.0250 mg/cm²hr.

The mechanical properties of the alloy in an as heat-treated condition at room temperature amounted to: tensile strength $|\sigma\rho|$=21–23 kgf/cm², and relative elongation $|\delta|$= 2–3%.

The alloy of the proposed composition ensures a high corrosion resistance for articles operating in the air, under marine and tropical conditions and during a short-term operation in sea water along with sufficiently high mechanical properties levels.

What we claim is:

1. A magnesium-base alloy consisting essentially of, by weight: 7.7 % aluminum, 2.0 % zinc, 0.5 % manganese, 0.005 % titanium 0.3 % zirconium, 0.007 % iron, 0.0007 % nickel, 0.03 % silicon, 0.02 % copper and the balance being magnesium.

2. A magnesium-base alloy consisting essentially of, by weight: 2 % aluminum, 2.5 % zinc, 2.5 % manganese, 0.5 % titanium, 0.002 % zirconium, 0.01 % iron, 0.001 % nickel, 0.08 % silicon, 0.04 % copper and the balance being magnesium.

3. A magnesium-base alloy consisting essentially of, by weight: 12 % aluminum, 0.01 %, zinc, 0.01 % manganese, 0.0001 % titanium, 2 % zirconium, 0.1 % beryllium, 0.003 % iron, 0.001 % nickel, 0.01 % silicon, 0.02 % copper and the balance being magnesium.

* * * * *